United States Patent [19]

Miller

[11] Patent Number: 4,583,486

[45] Date of Patent: Apr. 22, 1986

[54] APPARATUS FOR DEPOSITING GRANULES ON A MOVING SHEET

[75] Inventor: John A. Miller, Clearwater, Fla.

[73] Assignee: The Celotex Corporation, Tampa, Fla.

[21] Appl. No.: 696,813

[22] Filed: Jan. 31, 1985

[51] Int. Cl.[4] ..... B05C 5/02

[52] U.S. Cl. ..... 118/308; 222/415; 222/168; 427/188; 427/286

[58] Field of Search ..... 118/197, 308; 222/415, 222/168; 427/188, 286

[56] References Cited

U.S. PATENT DOCUMENTS

| | | | |
|---|---|---|---|
| 358,502 | 3/1987 | Swan | 91/68 |
| 1,289,328 | 12/1918 | Wardell | 91/68 |
| 1,928,274 | 9/1933 | Wettlaufer | 91/68 |
| 1,967,419 | 7/1934 | Moone | 91/43 |
| 1,995,032 | 3/1935 | Leonard, Jr. | 91/59 |
| 2,056,275 | 10/1936 | Holdsworth | 427/188 |
| 2,068,761 | 1/1937 | Penley | 427/188 |
| 2,139,619 | 12/1938 | Howell | 91/70 |
| 3,081,698 | 3/1963 | Childress et al. | 427/197 X |
| 3,310,205 | 3/1967 | Meyer | 118/308 X |
| 4,301,763 | 11/1981 | Goldstone et al. | 118/308 |

*Primary Examiner*—Shrive P. Beck

*Attorney, Agent, or Firm*—James W. Grace; Charles W. Vanecek

[57] ABSTRACT

The present invention relates to an apparatus in which a perforated belt travels across to a moving sheet upon which granules are deposited through holes in the belt.

7 Claims, 6 Drawing Figures

APPARATUS FOR DEPOSITING GRANULES ON A MOVING SHEET

BACKGROUND OF THE INVENTION

1. Field of the Invention

The present invention relates generally to an apparatus for depositing granules on a moving sheet. More particularly, this invention relates to an apparatus having a perforated belt which travels transversely with respect to a moving sheet upon which the granules are deposited through holes in the belt. The invention is especially useful in making roofing sheets or shingles.

2. Description of the Prior Art

For many years roofing sheets and shingles have been made by depositing slate granules on a sheet of organic or glass fiber material which has been impregnated with asphalt and has a coating of asphalt into which the granules become embedded. The granules serve as weather resistant elements to protect the underlying sheet and also to provide a degree of fire protection.

The apparatus for making the sheet is conventional, as is also the apparatus for impregnating and coating the sheet with asphalt. Prior to the invention, the slate granules have been deposited on the molten asphalt coating from a large hopper having an elongated slot in its lower edge. The granules flow through the slot onto the upper surface of the sheet. Various devices may be used to control the flow of the granules.

Although the conventional apparatus has been used for many years, it is not completely satisfactory in that it does not provide an easy adjustment of the flow of granules. Furthermore, the control devices on the hopper are large, cumbersome and at times difficult to adjust and keep clean.

It is desirable that a granule depositing device be provided which overcomes many of the shortcomings of the prior art hopper discharge control apparatus.

SUMMARY OF THE INVENTION

The invention provides an apparatus for depositing granules on a moving sheet in a controlled pattern and amount so that the appearance of the finished product can be adjusted, as desired.

It is an object of the present invention to provide a novel apparatus for depositing granules on a moving sheet.

It is a second object of the invention to provide a novel apparatus which can easily be adjusted to provide controlled amount and pattern of granules on the sheet.

It is yet another object of the invention to provide an apparatus which can be simply and easily adjusted to make a roofing sheet or shingle.

It is still another object of the invention to provide a novel apparatus which can be adjusted to provide a pattern of parallel lines of granules on a moving sheet.

Other features and objects of the present invention will become apparent to those skilled in the art when the present description is considered in the light of the accompanying drawings in which like numerals indicate like elements and in which.

DESCRIPTION OF THE PREFERRED EMBODIMENT

Figure 1:
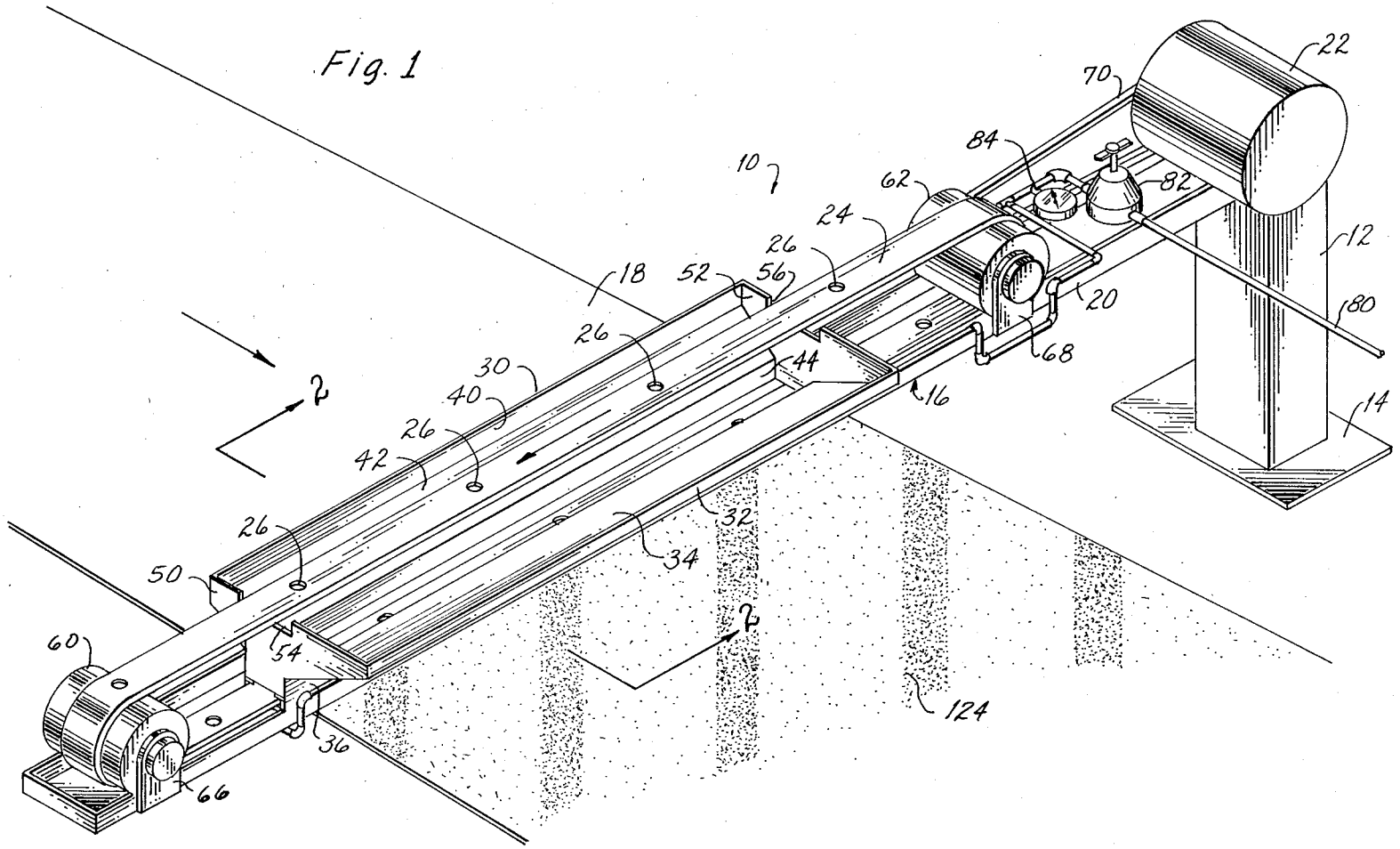
FIG. 1 is a perspective view of the novel granule applicator of the invention.

Referring now to the drawings and more specifically to FIG. 1 thereof, there is shown a perspective view of the apparatus of the invention. The main portion of the apparatus 10 is supported by a pedestal 12 which is affixed to a plate 14. Plate 14 is attached to the floor by suitable bolts (not shown).

The main operating part 16 of the apparatus is connected in cantilevered fashion to pedestal 12 and extends outwardly over a conveyor which carries sheet 18. Sheet 18 moves in the direction of the arrow below the main operating unit 16 of apparatus 10.

Main operating unit 16 comprises a frame 20 which is connected to the upper end of pedestal 12. Frame 20 extends across and above sheet 18. A drive motor 22 is mounted on frame 20 near pedestal 12. The drive motor may be any suitable electrical motor of sufficient horse power to cause rotation of perforated belt 24.

Perforated belt 24 is a flat belt which has spaced holes 26 cut through its surface along its center line. As will become apparent later, the size, spacing and number of holes 26 may be selectively varied to provide a large range of conditions for the deposition of granules upon sheet 18.

A hopper 30 is attached to frame 20 and overlies sheet 18. Hopper 30, which can be made of a relatively thin grade of sheet metal such as aluminum, comprises a short upright flange 32 along its upper edge and an inclined plate 34 connected to flange 32 and extending downwardly to integrally connect to an upright plate 36. Plate 36 extends the full length of inclined plate 34 along its lower edge. Upright plate 36 is connected to frame 20.

The other lateral side of hopper 30 comprises an upright flange 40 integrally connected to an inclined plate 42. The lower edge of inclined plate 42 connects to an upright plate 44 (better shown in FIG. 2). The lower edge of plate 44 is connected to frame 20. Two end plates 50 and 52 are welded to the outer ends of plates 32, 34, 36, 40, 42 and 44 to form a hopper which has an open top and bottom. Generally, the length of hopper 30 between end plates 50 and 52 is about the same distance as the width of moving sheet 18.

Cut-outs 54 and 56 are provided in the upper edges of end plates 50 and 52, respectively, to allow belt 24 to move over trough 30.

If desired, a cover (not shown) may be placed over the open top of hopper 30 to keep dust from escaping from the hopper. An opening along one side of the cover is provided to permit the feeding of granules into the hopper.

Along the bottom of hopper 30 and at each side thereof, there are provided elongated U-shaped channels 74 and 76 in which the lower portion of belt 24 rides. In order to prevent granules from packing between the belt 24 and the U-shaped channels 74 and 76, there is provided an air blowing system shown as pipes 80 with a control regulator 82 and a pressure gauge 84. Nozzles 90 (better shown in FIG. 2) are provided at suitably spaced intervals along pipes 80 so that air blowing through the nozzles across belt 24 keeps the outer edges of belt 24 from becoming clogged with granules.

It should be noted that the hopper is not symmetrical, as shown here, to provide a larger area for the reception of granules which are dropped into hopper 30 from a larger holding container by a conveyor (not shown). Obviously, hopper 30 may be symmetrical, if desired.

As may be seen, belt 24 is stretched between rollers 60 and 62 which are mounted on frame 20 outwardly of the end plates 50 and 52 of hopper 30. Roller 60 is mounted on journal bearings 66 connected to frame 20 while roller 62 is mounted on journal bearings 68 also connected to frame 20. Roller 62 is connected to drive motor 22 by a belt 70 which drives roller 62, and thus, belt 24.

The operation of the apparatus for depositing granules on a sheet may be described with reference to making a roofing sheet or shingles.

Figure 3:
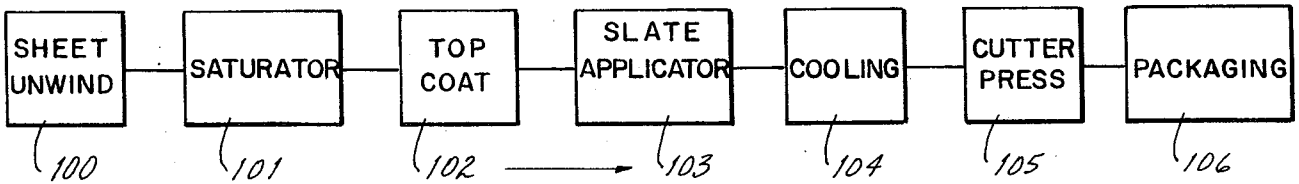
FIG. 3 is a block diagram showing the steps of making a granule coated sheet or shingle.

Referring now more specifically to FIG. 3, there is shown a flow diagram of the process of producing a roofing shingle. It will be recognized that many of the basic steps of manufacture of the shingle are conventional and are carried out by well-known standard apparatus to be found in any roofing plant. The invention resides in the novelty of the granule depositing apparatus.

Hence, in order to avoid undue complexity and to describe the invention in as concise a fashion as possible, the individual pieces of apparatus such as conventional electric motors, bearings, shafts, rolls, conveyors, frames, nuts bolts, etc., have not been described.

The process may be described by observing the flow sheet of FIG. 3 and following the arrow which represents the sheet 18 in its initial condition as a roll of felted paper to the finished shingle.

The sheet 18 is most generally of suitable felted paper or rag felt of approximately 112 pounds per 1,000 square feet, about 68 mils in thickness. For purposes of this invention, the sheet 18 will preferably be 33 inches in width, or multiples thereof, although other widths can be chosen without departing from the scope of the invention. The sheet 18, as supplied by the manufacturer, is wound on a mandrel or core which is suspended on a bracket to permit unwinding of the sheet. The sheet unwind station is indicated by the numeral 100.

The sheet 18 is subjected to a saturation step in saturator 21. Generally, the sheet is formed in a series of loops the lower portions of which are submerged in a bath of hot liquid asphalt for a period of time sufficient to thoroughly saturate the sheet. Any moisture remaining in the sheet is driven off. The asphalt impregnated sheet 18 may have a top coat of asphalt or bitumen applied to the top surface of the sheet 18 at station 102.

The slate or granule applicator is represented by station 103 at which location a top coating of roofing granules are deposited on the sheets. At station 103 the granules may be deposited by a conventional applicator for uniform distribution of granules over the exposed surface of the moving sheet and the granule depositing apparatus of the invention may be placed either in front of or after the conventional granule applicator. At the station 103, the granules may be deposited to form a pattern in the manner to be described later.

The sheet is then cooled at station 104, cut into suitable lengths and cut into the appropriate shape at station 105 if it is to become a roofing shingle. Following the cutting step, the roofing sheet or shingle is packaged for shipment at station 106.

Figure 2:
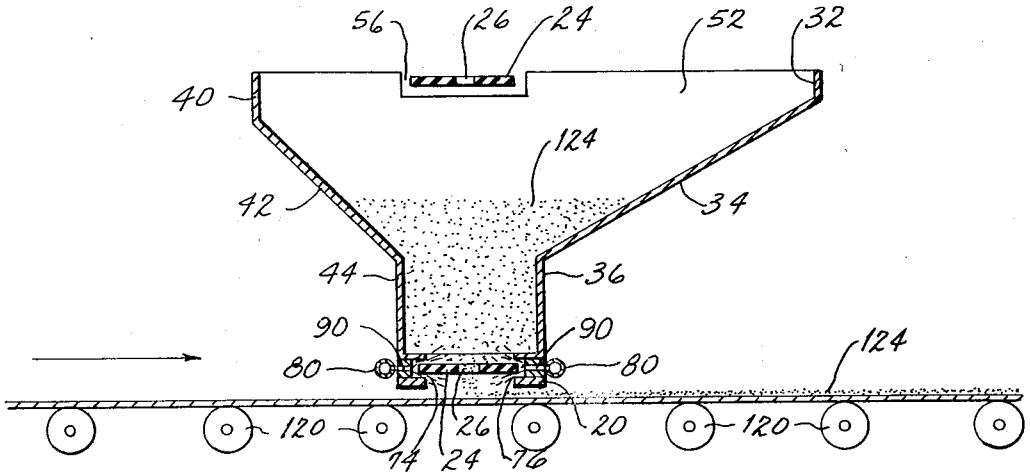
FIG. 2 is a cross-sectional view of the apparatus of FIG. 1 taken along lines 2—2 thereof.

Referring now specifically to FIGS. 1 and 2 there is shown the apparatus of the invention. In operation, sheet 18, which has been saturated at station 101 and has received a top coat of asphalt at station 102 (if desired), is conveyed by a conveyor, represented by a series of rollers 120 below granule depositing apparatus 10.

In this embodiment a conventional granule depositing device may be located ahead of the granule depositing apparatus of the invention to deposit a uniform layer of granules over the exposed surface of sheet 18.

Granules 124 are fed to hopper 30 of apparatus 10 from a storage container (not shown). The granules 124 fall upon the upper surface of the lower run of belt 24. Drive motor 22 has been turned on and belt 24 moves around roller 60 and 62.

Granules 124 fall through the holes 26 in belt 24 and are deposited on the upper surface of sheet 18 where they become embedded in the soft asphalt top coating.

Air flows through nozzles 90 to keep the granules from flowing between belt 24 and the U-shaped channels 74 and 76 to prevent an accumulation of granules to bind belt 24.

It is apparent that the quantity of granules deposited on the upper surface of sheet 18 in any given time period can be easily adjusted by selecting the size of the holes 26, the number of holes 26 per unit length of belt 24 and the speed of movement of belt 24. Thus, by a simple adjustment of the speed of drive motor 22, a large variation in the quantity of granules deposited on sheet 18 can be easily achieved. A similar effect can be achieved by determining the speed of advance of sheet 18 beneath hopper 30 with respect to the speed of movement of belt 24.

More specifically, granule applicator 10 deposits the granules through the moving holes 26 onto moving sheet 18. It should be understood that because each hole 26 moves across sheet 18 and because sheet 18 is moving at an angle with respect to the direction of movement of the holes, the granules will not necessarily be deposited in a line perpendicular to the longitudinal axis of sheet 18. The line of deposition of the granules will be at an angle with respect to the longitudinal axis of the moving sheet and the angle between the direction of the line of the granules 124 and the longitudinal axis of the moving sheet will be determined by the relative speed of the belt 24 and the moving sheet 18 and also by the angular location of the granule applicator with respect to the moving sheet.

For example, if the granule applicator is located as shown in FIG. 1 so that the main operating unit 16 is perpendicular to the longitudinal axis of moving sheet 18 and if the speed of movement of belt 24 equals the speed of forward movement of moving sheet 18, then the granules 125 will be deposited from each hole 26 along a line which will be at an angle of 45° with respect to the longitudinal axis of moving sheet 18. Each line of granules will be parallel to the next adjacent line of granules and spaced from each adjacent line of granules by a distance equal to the distance between the holes 26.

If it is desired to make the lines of granules perpendicular to the longitudinal axis of moving sheet 18, main operating unit 16 can be placed so that it is located at an angle of 45° wth respect to the longitudinal axis of moving sheet 18 and having its outer edge forward or downstream with respect to the movement of sheet 18. If now the speed of belt 24 is adjusted to be 1.414 times the speed of moving sheet 18, the lines of granules will be parallel to each other and perpendicular to the longitudinal axis of moving sheet 18.

Thus, by locating the main operating unit 16 at a predetermined angle with respect to the longitudinal axis of sheet 18 and adjusting the relative speeds of the belt 24 and the moving sheet 18, a number of patterns of lines of granules can be made.

If additional granule depositing machines are used, a larger number of different patterns of lines of granules can be achieved.

Figure 4:
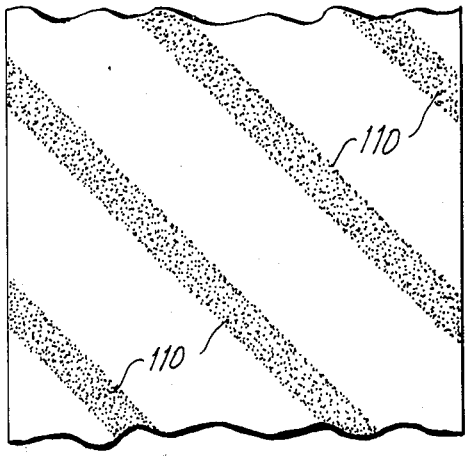
FIGS. 4, 5 and 6 are top views of sheets showing patterns formed by lines of granules deposited by the novel granule coating apparatus of the invention.
Figure 5:
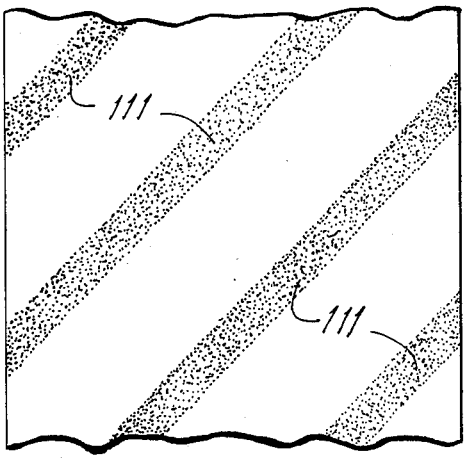
Figure 6:
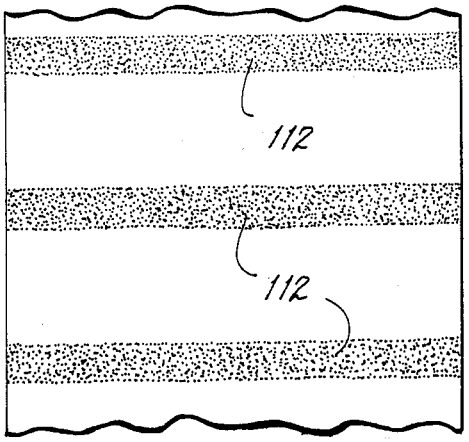

Certain of the various patterns are shown in FIGS. 4, 5 and 6 in which sheet 18 is illustrated with lines of granules 110, 111 and 112.

What has been described is a novel apparatus for depositing granules on a moving sheet, but it should be understood that the invention is not to be limited thereto, as many modifications may be made. It is, therefore, contemplated to cover by the present application any and all such modifications as fall within the scope of the appended claims.

I claim:

1. An apparatus for depositing granules on a moving sheet which sheet moves in a predetermined direction in a plane below said apparatus comprising: a hopper spaced a predetermined distance above said sheet adapted to receive granules, said hopper having at least two downwardly, inwardly sloping sides separated by an open area, a perforated belt adapted to close said open area and means to drive said belt in a predetermined non-reciprocal direction only, whereby granules received by said hopper drop through said perforations in said belt and are deposited on said moving sheet.

2. An apparatus for depositing granules on a moving sheet as recited in claim 1 in which said belt extends across said sheet and a at predetermined angle with respect to the direction of movement of said moving sheet.

3. An apparatus for depositing granules on a moving sheet as recited in claim 1 in which said belt extends across said sheet and is perpendicular to the direction of movement of said moving sheet.

4. An apparatus for depositing granules on a moving sheet as recited in claim 1 in which the length of said hopper is equal to the width of said moving sheet.

5. An apparatus for depositing granules on a moving sheet as recited in claim 1 in which said hopper has a pair of opposed, facing guide channels located along the bottom thereof and a portion of said belt travels within said guide channels.

6. An apparatus for depositing granules on a moving sheet as recited in claim 5 in which air nozzles are attached to said guide channels at spaced distances, whereby air blown through said air nozzles prevent granules from collecting between said belt and said guide channels.

7. An apparatus for depositing granules on a moving sheet as recited in claim 2 in which said means to drive said belt can be adjusted to vary the relative speed of movement of said belt and said moving sheet, such that regardless of the predetermined angle between the direction of movement of said sheet and the direction of movement of said belt, the line of deposition of said granules will be perpendicular to the longitudinal axis of said sheet.

* * * * *